US006354762B1

(12) United States Patent
Muramatsu

(10) Patent No.: US 6,354,762 B1
(45) Date of Patent: Mar. 12, 2002

(54) MOUNTING MEMBER AND FLEXIBLE MEMBRANE DAM

(75) Inventor: Tateo Muramatsu, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/541,678

(22) Filed: Mar. 31, 2000

(30) Foreign Application Priority Data

Apr. 5, 1999 (JP) ..... 11-098079

(51) Int. Cl.[7] ..... E02B 7/20

(52) U.S. Cl. ..... 405/115; 405/107; 405/87; 405/91

(58) Field of Search ..... 405/90, 91, 107, 405/110, 115, 87; 248/506; 24/459, 569, 135 R

(56) References Cited

U.S. PATENT DOCUMENTS

| | | | | | |
|---|---|---|---|---|---|
| 1,730,197 | A | * | 10/1929 | Elsey | 24/135 R |
| 3,734,443 | A | | 5/1973 | Fukuda | |
| 3,975,915 | A | * | 8/1976 | Haw | 405/110 |
| 4,167,358 | A | | 9/1979 | Besha | |
| 4,836,713 | A | * | 6/1989 | Muramatsu et al. | 405/115 |
| 5,067,851 | A | * | 11/1991 | Fujisawa et al. | 405/115 |
| 5,214,891 | A | | 6/1993 | Edlin | |
| 5,388,928 | A | * | 2/1995 | Kumagai | 405/115 |
| 6,179,521 | B1 | * | 1/2001 | Muramatsu et al. | 405/115 |

FOREIGN PATENT DOCUMENTS

| | | | | |
|---|---|---|---|---|
| GB | A-2 077 825 | | 12/1981 | |
| JP | 5721610 | A * | 4/1982 | E02B/7/20 |
| JP | 6278307 | A * | 4/1987 | E02B/7/20 |
| JP | 6255311 | * | 11/1987 | E02B/7/20 |
| JP | 430012 | A * | 3/1992 | E02B/7/20 |
| JP | A-10-96225 | | 4/1998 | |
| JP | 10-96225 | A * | 4/1998 | E02B/7/20 |

* cited by examiner

*Primary Examiner*—David Bagnell
*Assistant Examiner*—Katherine Mitchell
(74) *Attorney, Agent, or Firm*—Oliff & Berridge, PLC

(57) ABSTRACT

A flexible membrane dam is provided which can be installed easily and in which a concentration of stress at a time the dam is made to stand is less than in conventional structures. Mounting hardware for the dam is also provided. When a fluid such as air is supplied to an interior of a flexible membrane, the flexible membrane inflates and stands, and tension acts on the flexible membrane . At inclined surface portions, a vicinity of an outer peripheral edge of the flexible membrane is, in a convex and concave shape, nipped and fixed between an upper pressing hardware and a lower pressing hardware . At the upper pressing hardware, a ratio (AE1/AE1')×100 of a length AE1 from a point E1 of a concave portion to a point A, to a length AE1' from a point E1' of a convex portion to the point A, is 85 or more. Namely, the length AE1' is close to the length AE1. Thus, at an inflated main body side of the flexible membrane, local drawing up of the flexible membrane by the upper pressing hardware is suppressed, i.e., a concentration of stress at the flexible membrane when inflated is suppressed. The flexible membrane can be stand up in a planar shape from end portions of the upper pressing hardware.

20 Claims, 11 Drawing Sheets

MOUNTING MEMBER AND FLEXIBLE MEMBRANE DAM

BACKGROUND OF THE INVENTION

1. Field of the Invention

The present invention relates to flexible membrane dam which is disposed at the bottom of a body of water and is used as a weir, a wave-breaking dyke, or the like, and to a mounting member used for fixing the flexible membrane dam. In particular, the present invention relates to a flexible membrane dam which, due to the inflation and contraction of the flexible membrane, i.e., due to the flexible membrane dam being erected and collapsed, can effectively prevent or control the flow of water, the propagation of waves, or the like, and at which concentration of stress when the dam is erected can be prevented, and to a mounting member for this flexible membrane dam.

2. Description of the Related Art

The flexible membrane which forms the main body of a flexible membrane dam is formed as a flat, elongated sheet by integrally vulcanization molding a reinforcing core body layer such as ordinary canvas or the like with an elastic body such as rubber or the like.

Such a flexible membrane is three-dimensionally mounted to a foundation having a river bottom surface portion of the foundation, which is substantially horizontal at the bottom of a river and corresponds to the bottom of a river, and an inclined surfaces portion of the foundation, which correspond to slanted surfaces such as river banks or dykes or the like. The flexible membrane inflates into a three-dimensional configuration having curved surfaces in three dimensions.

In order to mount the flat, elongated flexible membrane along the widthwise direction of a river three-dimensionally as described above, it is necessary to use a special means therefor.

One example of a flexible membrane dam is disclosed in Japanese Patent Application Laid-Open (JP-A) No. 10-96225.

In this flexible membrane dam, step-like portions are formed in the inclined surfaces portion for easing the concentration of stress which occurs when the flexible membrane is standing. The outer peripheral edge portion of the flexible membrane is mounted to these step-like portions.

However, providing such step-like portions in the inclined surfaces portion makes installation complex and requires much work.

Further, by providing the step-like portions in the inclined surfaces portion, the concentration of stress at the time the flexible membrane is standing is alleviated to a certain extent, but an even greater suppression of such concentration of stress is desired.

SUMMARY OF THE INVENTION

In view of the aforementioned, an object of the present invention is to provide a flexible membrane dam and a mounting member in which installation is easy, and a concentration of stress at the time a flexible membrane is standing can be alleviated even more than in the conventional art.

A first aspect of the present invention is a mounting member used in a flexible membrane dam which is formed by a flexible expanding-and-contracting structural body which is formed from a flexible membrane and is made to stand by a fluid being supplied to an interior thereof and made to collapse by fluid being discharged from the interior thereof; and a structure at which the flexible expanding-and-contracting structural body is provided, the mounting member comprising: a first member and a second member, wherein the first member is provided at the structure and abuts one surface of the flexible membrane, the second member abuts another surface of the flexible membrane, a vicinity of an outer peripheral edge of the flexible membrane is nipped by a fixing means between the first member and the second member, at a surface of the first member which abuts the flexible membrane, first concave portions and first convex portions, which extend in a direction orthogonal to the outer peripheral edge of the flexible membrane, are provided alternately along the outer peripheral edge of the flexible membrane, at a surface of the second member which abuts the flexible membrane, second convex portions which oppose the first concave portions and second concave portions which oppose the first convex portions are provided alternately along the outer peripheral edge of the flexible membrane, and a length L1 of the flexible membrane, in a state in which the flexible membrane is set in close contact with bottom surface of the second concave portion, from a flexible membrane outer peripheral edge side end portion of the second concave portion to an end portion of the second concave portion at a side opposite the flexible membrane outer peripheral edge side of the second concave portion, and a length L2 of the flexible membrane, in a state in which the flexible membrane is set in close contact with peak surface of the second convex portion, from a flexible membrane outer peripheral edge side end portion of the second convex portion to an end portion of the second convex portion at a side opposite the flexible membrane outer peripheral edge side of the second convex portion, are substantially equal.

In the first aspect, the mounting member is provided at the structure at which the flexible expanding-and-contracting structural body is provided ,at the flexible membrane dam which is set in a river or the like. More specifically, the mounting member is provided at the inclined surface portion of the structure (the mounting base).

The flexible membrane is nipped between the first member and the second member and is fixed by a fixing means (e.g., anchor bolts provided at the structure, and nuts screwed therewith, or the like).

A vicinity of the outer peripheral edge of the flexible membrane is nipped and fixed between the first member and the second member. In this way, the vicinity of the outer peripheral edge of the flexible membrane is curved in a convex and concave shape along the direction of the outer peripheral edge.

When a fluid such as air is supplied to the interior of the flexible expanding-and-contracting structural body formed from the flexible membrane so that the flexible expanding-and-contracting structural body inflates and stands, the portions of the flexible membrane at the side opposite the outer peripheral edge side stand substantially orthogonally with respect to the inclined surfaces portion. Further, due to these portions being pulled in the substantially orthogonal direction with respect to the outer peripheral edge, the flexible membrane is fit closely to the bottom surfaces of the concave portions and the peak surfaces of the convex portions of the second member.

Here, because L1 (for the second concave portion) and L2 (for the second convex portion) are set to be substantially equal, the formation of convex and concave portions in the standing portions of the flexible membrane is prevented. At the inflated flexible expanding-and-contracting structural body, stress is applied uniformly in the direction of the outer peripheral edge of the flexible membrane. Accordingly, there is no concentration of stress caused by the formation of convex and concave portions in the flexible membrane, and thus, the durability of the flexible membrane improves.

In second aspect of the present invention, in the mounting member of the first aspect, (L1/L2)×100 is substantially in a range of 80 to 120.

L1 is a length of the flexible membrane, in a state in which the at flexible membrane is set in close contact with bottom surface of the second concave portion, from a flexible membrane outer peripheral edge side end portion of the second concave portion to an end portion of the second concave portion at a side opposite the flexible membrane outer peripheral edge side of the second concave portion. L2 is a length of the flexible membrane, in a state in which the flexible membrane is set in close contact with peak surface of the second convex portion, from a flexible membrane outer peripheral edge side end portion of the second convex portion to an end portion of the second convex portion at a side opposite the flexible membrane outer peripheral edge side of the second convex portion. The ratio of L1 to L2, i.e., (L1/L2)×100, falls in the range of 80 to 120. Namely, the length L2 is close to the length L1. Thus, in the flexible expanding-and-contracting structural body which is inflated, stress is applied uniformly in the direction of the outer peripheral edge of the flexible membrane.

If (L1/L2)×100 falls out of the range of 80 to 120, when the flexible expanding-and-contracting structural body inflates, there will be a local concentration of stress at the flexible membrane in a vicinity of the second member, which is not preferable.

It is preferable that (L1/L2)×100 is 85 to 115, and more preferable that (L1/L2)×100 is 95 to 105.

In the mounting member of the first or the second aspect, a plurality of ribs extending along the outer peripheral edge of the flexible membrane are provided at the surface of the second member which abuts the flexible membrane, and a number of ribs provided at the second convex portion is smaller than a number of ribs provided at the second concave portion.

Ribs, which extend along the outer peripheral edge of the flexible membrane, are formed at the surface of the second member which opposes the first member. In this way, the friction generated between the second member and the flexible membrane increases, and slipping at the time a large tensile force is applied to the flexible membrane can be prevented.

The number of ribs of the second convex portions is less than the number of ribs of the second concave portions. Thus, the length L2 is made to be closer to the length L1 by an amount corresponding to this number of ribs which are the difference between the number of ribs of the second convex portions and the number of ribs of the second concave portions.

In a fourth aspect of the present invention, in any of the first through third aspects, an end portion of the second member at a side opposite a flexible membrane outer peripheral edge side of the second member includes a chamfer.

The end portion of the second member at the side opposite the flexible membrane outer peripheral edge side is a portion which abuts the flexible membrane and bendingly deforms the flexible membrane. If this end portion is sharp, the flexible membrane will bend abruptly, and the durability thereof will deteriorate. Accordingly, by subjecting this end portion to chamfering processing, the durability of the flexible membrane improves.

In a fifth aspect of the present invention, in the mounting member of the fourth aspect, the chamfer has a radius of curvature.

By subjecting the end portion of the second member at the side opposite the flexible membrane outer peripheral edge side to R chamfering processing, the flexible membrane curves gradually, and thus, the durability thereof is improved even more.

In a sixth aspect of the present invention, in the mounting member of the fifth aspect, the flexible membrane has a thickness T, and a radius of curvature at the second convex portion is R, R>2.5T.

The thickness of the flexible membrane is T, and the R chamfering processed radius of curvature at the second convex portion is R. If R>2.5T, the portion abutting the flexible membrane will be a smooth circular arc.

If R≦2.5T, the R chamfering processed radius of curvature will be small with respect to the thickness of the flexible membrane, and the end portion will resemble a sharp configuration which is not preferable.

It is preferable that R>3.0T, and more preferable that R>3.5T.

In a seventh aspect of the present invention, in the mounting member of the fourth aspect, a radius of curvature at the second concave portion is smaller than the radius of curvature at the second convex portion.

A eighth aspect of the present invention is a flexible membrane dam formed by a flexible expanding-and-contracting structural body which is formed from a flexible membrane and is made to stand by a fluid being supplied to an interior thereof and made to collapse by fluid being discharged from the interior thereof; and a structure at which the flexible expanding-and-contracting structural body is provided, the flexible membrane dam having a mounting member, the mounting member being formed by a first member and a second member, wherein the first member is provided at the structure and abuts one surface of the flexible membrane, the second member abuts another surface of the flexible membrane, a vicinity of an outer peripheral edge of the flexible membrane is nipped by a fixing means between the first member and the second member, at a surface of the first member which abuts the flexible membrane, first concave portions and first convex portions, which extend in a direction orthogonal to the outer peripheral edge of the flexible membrane, are provided alternately along the outer peripheral edge of the flexible membrane, at a surface of the second member which abuts the flexible membrane, second convex portions which oppose the first concave portions and second concave portions which oppose the first convex portions are provided alternately along the outer peripheral edge of the flexible membrane, and a length L1 of the flexible membrane, in a state in which the flexible membrane is set in close contact with bottom surface of the second concave portion, from a flexible membrane outer peripheral edge side end portion of the second concave portion to an end portion of the second concave portion at a side opposite the flexible membrane outer peripheral edge side of the second concave portion, and a length L2 of the flexible membrane, in a state in which the flexible membrane is set in close contact with peak surface of the second convex portion, from a flexible membrane outer peripheral edge side end portion of the second convex portion to an end portion of the second convex portion at a side opposite the flexible membrane outer peripheral edge side of the second convex portion, are substantially equal.

In the eighth aspect, the mounting member is provided at the structure at which the flexible expanding-and-contracting structural body is provided ,at the flexible membrane dam which is set in a river or the like. More specifically, the mounting member is provided at the inclined surface portion of the structure (the mounting base).

The flexible membrane is nipped between the first member and the second member and is fixed by a fixing means (e.g., anchor bolts provided at the structure, and nuts screwed therewith, or the like).

A vicinity of the outer peripheral edge of the flexible membrane is nipped and fixed between the first member and the second member. In this way, the vicinity of the outer peripheral edge of the flexible membrane is curved in a convex and concave shape along the direction of the outer peripheral edge.

When a fluid such as air is supplied to the interior of the flexible expanding-and-contracting structural body formed from the flexible membrane so that the flexible expanding-and-contracting structural body inflates and stands, the portions of the flexible membrane at the side opposite the outer peripheral edge side stand substantially orthogonally with respect to the inclined surfaces portion. Further, due to these portions being pulled in the substantially orthogonal direction with respect to the outer peripheral edge, the flexible membrane is fit closely to the bottom surfaces of the concave portions and the peak surfaces of the convex portions of the second member.

Here, because L1 (for the second concave portion) and L2 (for the second convex portion) are set to be substantially equal, the formation of convex and concave portions in the standing portions of the flexible membrane is prevented. At the inflated flexible expanding-and-contracting structural body, stress is applied uniformly in the direction of the outer peripheral edge of the flexible membrane. Accordingly, there is no concentration of stress caused by the formation of convex and concave portions in the flexible membrane, and thus, the durability of the flexible membrane improves.

In ninth aspect of the present invention, in the flexible membrane dam of the eighth aspect, (L1/L2)×100 is substantially in a range of 80 to 120.

L1 is a length of the flexible membrane, in a state in which the flexible membrane is set in close contact with bottom surface of the second concave portion, from a flexible membrane outer peripheral edge side end portion of the second concave portion to an end portion of the second concave portion at a side opposite the flexible membrane outer peripheral edge side of the second concave portion. L2 is a length of the flexible membrane, in a state in which the flexible membrane is set in close contact with peak surface of the second convex portion, from a flexible membrane outer peripheral edge side end portion of the second convex portion to an end portion of the second convex portion at a side opposite the flexible membrane outer peripheral edge side of the second convex portion. The ratio of L1 to L2, i.e., (L1/L2)×100, falls in the range of 80 to 120. Namely, the length L2 is close to the length L1. Thus, in the flexible expanding-and-contracting structural body which is inflated, stress is applied uniformly in the direction of the outer peripheral edge of the flexible membrane.

If (L1/L2)×100 falls out of the range of 80 to 120, when the flexible expanding-and-contracting structural body inflates, there will be a local concentration of stress at the flexible membrane in a vicinity of the second member, which is not preferable.

It is preferable that (L1/L2)×100 is 85 to 115, and more preferable that (L1/L2)×100 is 95 to 105.

In a tenth aspect of the present invention, in the flexible membrane dam of the eighth or the ninth aspect, a plurality of ribs extending along the outer peripheral edge of the flexible membrane are provided at the surface of the second member which abuts the flexible membrane, and a number of ribs provided at the second convex portion is smaller than a number of ribs provided at the second concave portion.

Ribs, which extend along the outer peripheral edge of the flexible membrane, are formed at the surface of the second member which opposes the first member. In this way, the friction generated between the second member and the flexible membrane increases, and slipping at the time a large tensile force is applied to the flexible membrane can be prevented.

The number of ribs of the second convex portions is less than the number of ribs of the second concave portions. Thus, the length L2 is made to be closer to the length L1 by an amount corresponding to this number of ribs which are the difference between the number of ribs of the second convex portions and the number of ribs of the second concave portions.

In a eleventh aspect of the present invention, in any of the eighth through tenth aspects, an end portion of the second member at a side opposite a flexible membrane outer peripheral edge side of the second member includes a chamfer.

The end portion of the second member at the side opposite the flexible membrane outer peripheral edge side is a portion which abuts the flexible membrane and bendingly deforms the flexible membrane. If this end portion is sharp, the flexible membrane will bend abruptly, and the durability thereof will deteriorate. Accordingly, by subjecting this end portion to chamfering processing, the durability of the flexible membrane improves.

In a twelfth aspect of the present invention, in the flexible membrane dam of the eleventh aspect, the chamfer has a radius of curvature.

By subjecting the end portion of the second member at the side opposite the flexible membrane outer peripheral edge side to R chamfering processing, the flexible membrane curves gradually, and thus, the durability thereof is improved even more.

In a thirteenth aspect of the present invention, in the flexible membrane dam of the twelfth aspect, the flexible membrane has a thickness T, and a radius of curvature at the second convex portion is R, R>2.5T.

The thickness of the flexible membrane is T, and the R chamfering processed radius of curvature at the second convex portion is R. If R>2.5T, the portion abutting the flexible membrane will be a smooth circular arc.

If R≦2.5T, the R chamfering processed radius of curvature will be small with respect to the thickness of the flexible membrane, and the end portion will resemble a sharp configuration which is not preferable.

It is preferable that R>3.0T, and more preferable that R>3.5T.

In a fourteenth aspect of the present invention, in the flexible membrane dam of the twelfth aspect, a radius of curvature at the second concave portion is smaller than the radius of curvature at the second convex portion.

In a fifteen aspect of the present invention, a device for fastening a flexible membrane of an inflatable dam to a supporting structure, the device comprising: (a) a first member having a serpentine surface, and an opposing surface for placement against a supporting structure; (b) a second member having a serpentine surface corresponding to the serpentine surface of the first member, wherein when the device fastens a flexible membrane of a dam to a supporting structure, a section of the flexible member is sandwiched between the serpentine surfaces of the first and second members, with at least a portion of the serpentine surfaces nesting with one another; and (c) bolts connecting the first and second members against a supporting structure, when the device fastens a flexible membrane of an inflatable dam to a supporting structure, is provided.

DESCRIPTION OF THE PREFERRED EMBODIMENT

An embodiment of a flexible membrane dam relating to the present invention will be described hereinafter with reference to FIGS. 1 through 11.

Figure 1:
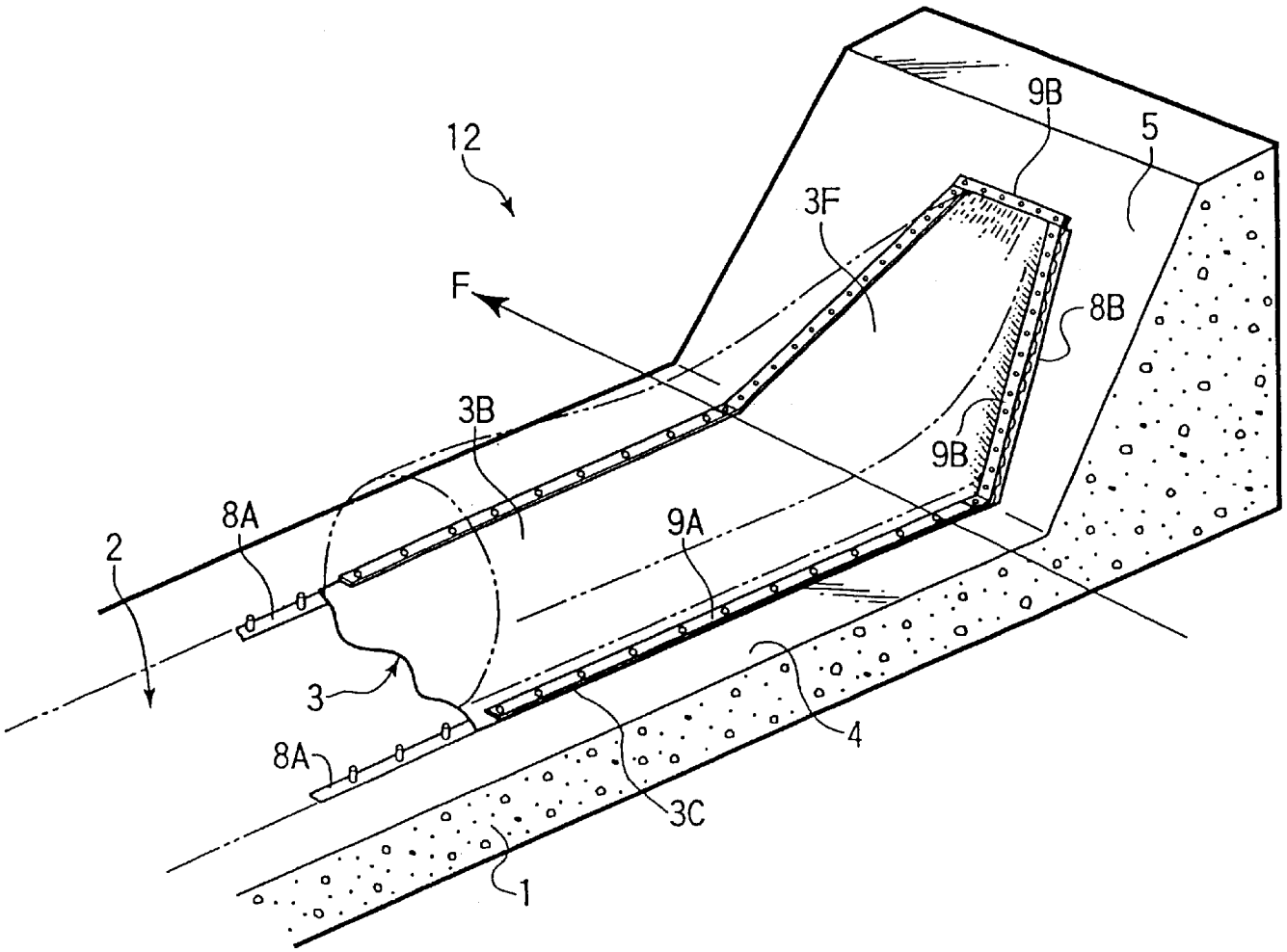
FIG. 1 is a perspective view illustrating a flexible membrane dam relating to an embodiment of the present invention.

FIG. 1 is a perspective view of a flexible membrane dam 12 of the present embodiment.

In FIG. 1, reference numeral 1 is a mounting base which is formed of concrete or the like, 2 is an installation surface of the mounting base 1 at which a flexible membrane 3 is installed. Arrow F indicates the direction in which water flows (i.e., points downstream).

Figure 2A:
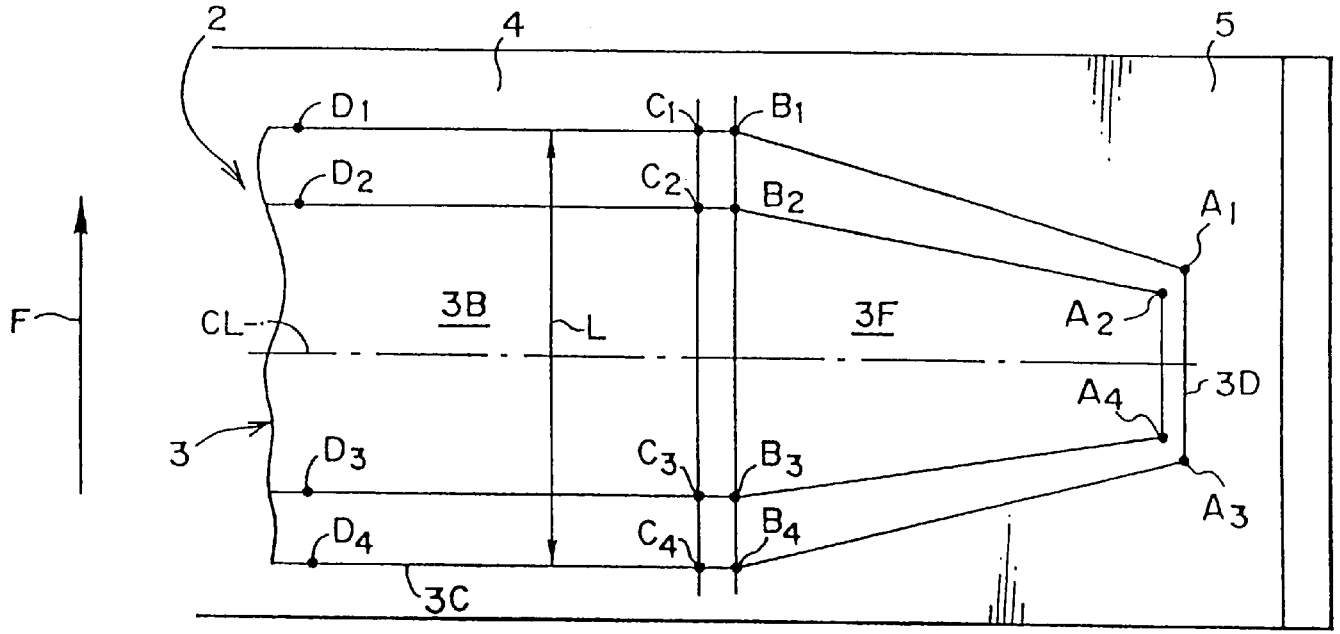
FIG. 2A is a top view of a flexible membrane and an installation surface.

FIG. 2A is an expanded view of the installation surface 2 and the flexible membrane 3.

As illustrated in FIG. 2A, the configuration of the flexible membrane 3 when the flexible membrane 3 is laid-out flat is the configuration of a two-dimensional flat sheet. A longitudinal direction intermediate portion 3B of the flexible membrane 3 is a constant width L. Both longitudinal direction end portions 3F of the flexible membrane 3 taper into trapezoidal configurations.

Figure 2B:
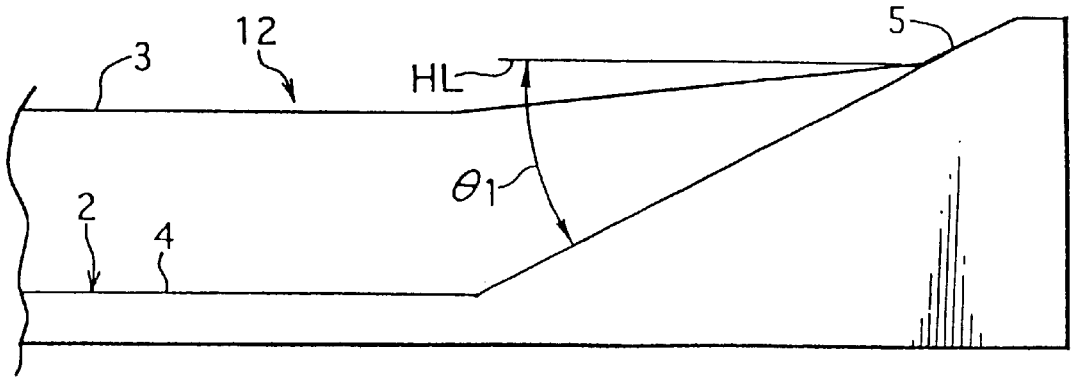
FIG. 2B is a cross-sectional view, taken in a direction orthogonal to the flow of a river, of a mounting base.

As illustrated in FIGS. 1 and 2B, the installation surface 2 for installation of the flexible membrane 3 includes a river bottom surface portion 4 and inclined surface portions 5. The river bottom surface portion 4 is substantial horizontal (or may be inclined slightly toward the downstream side), and the longitudinal direction intermediate portion 3B of the flexible membrane 3 is fixed thereat. The inclined surface portions 5 are slanted and are continuous with the river bottom surface portion 4, and the longitudinal direction end portions 3F of the flexible membrane 3 are fixed thereat.

As illustrated in FIG. 2B, the inclined surface portion 5 is slanted overall at an angle $\theta 1$ with respect to a horizontal line HL.

Figure 3:
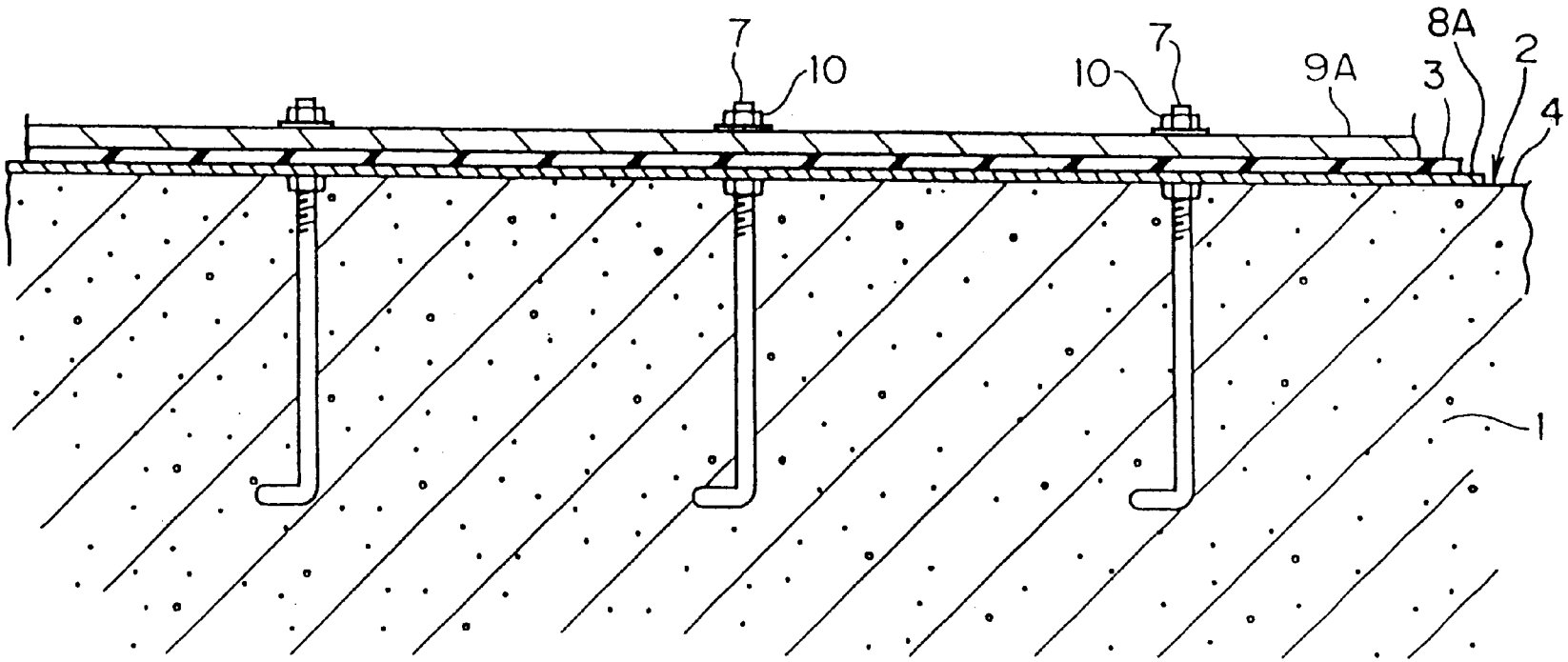
FIG. 3 is a cross-sectional view illustrating a fixing portion of the flexible membrane at a river bottom surface portion.

As illustrated in FIG. 3, lower pressing hardware 8A are placed at the river bottom surface portion 4 of the installation surface 2 at the portions at which the flexible membrane 3 is to be mounted.

Portions of constant widths in a vicinity of outer peripheral edges E of the longitudinal direction intermediate portion 3B of the flexible membrane 3 are nipped between the lower pressing hardware 8A and upper pressing hardware 9A.

Anchor bolts 7 are embedded into the mounting base 1 along the lower pressing hardware 8A. A portion of the anchor bolt 7 passes through the lower pressing hardware 8A, the flexible membrane 3, and the upper pressing hardware 9A. A nut 10 is screwed on the anchor bolt 7 so as to fasten the anchor bolt 7. A constant width portion of the flexible membrane 3 in a vicinity of the outer peripheral edge E thereof is thereby fixed between the upper pressing hardware 9A and the lower pressing hardware 8A.

The lower pressing hardware 8A are fixed by the anchor bolts 7 which are embedded in the mounting base 1.

Figure 4:
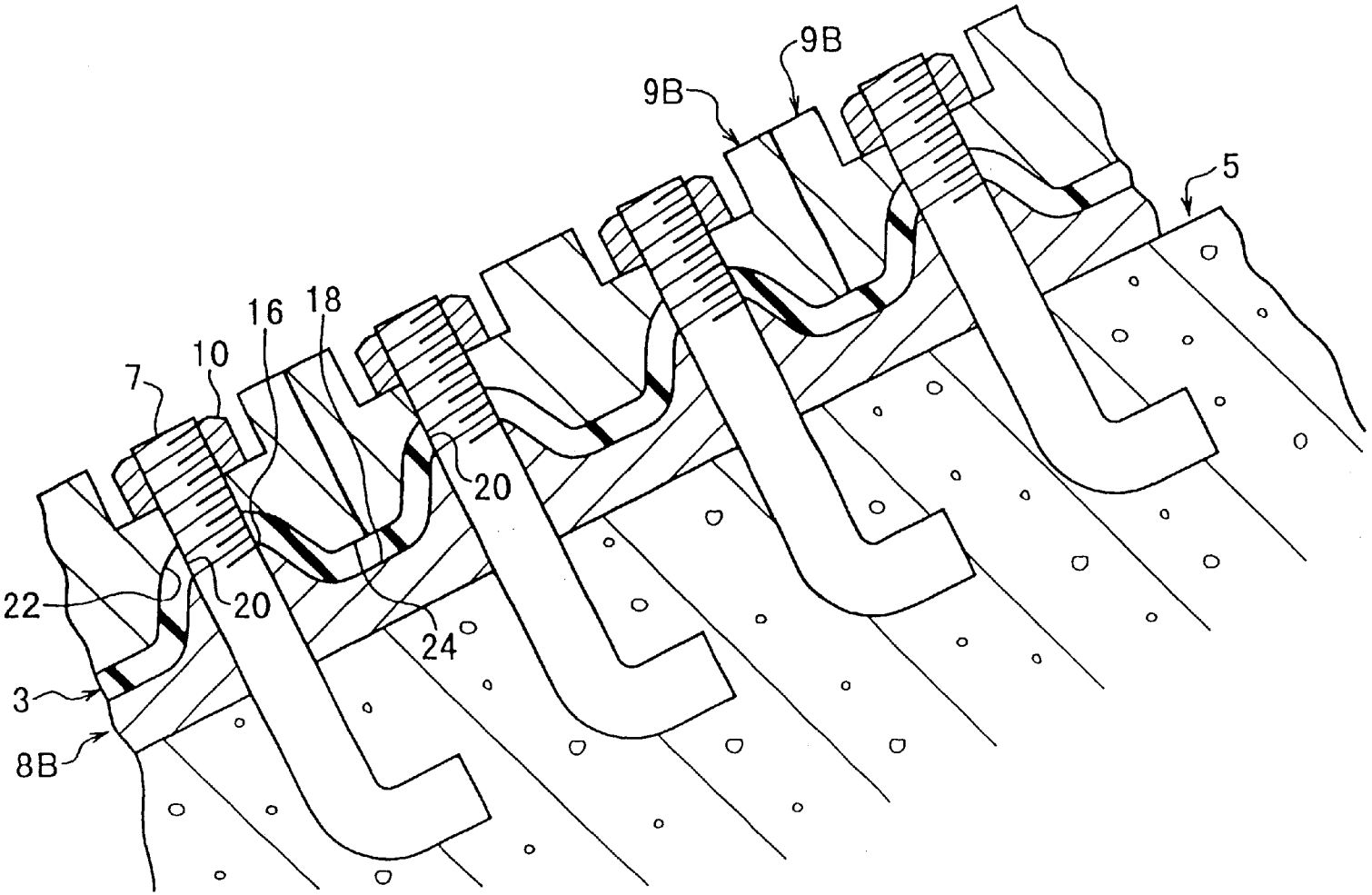
FIG. 4 is a cross-sectional view of a fixing portion of the flexible membrane at an inclined surface portion.
Figure 5:
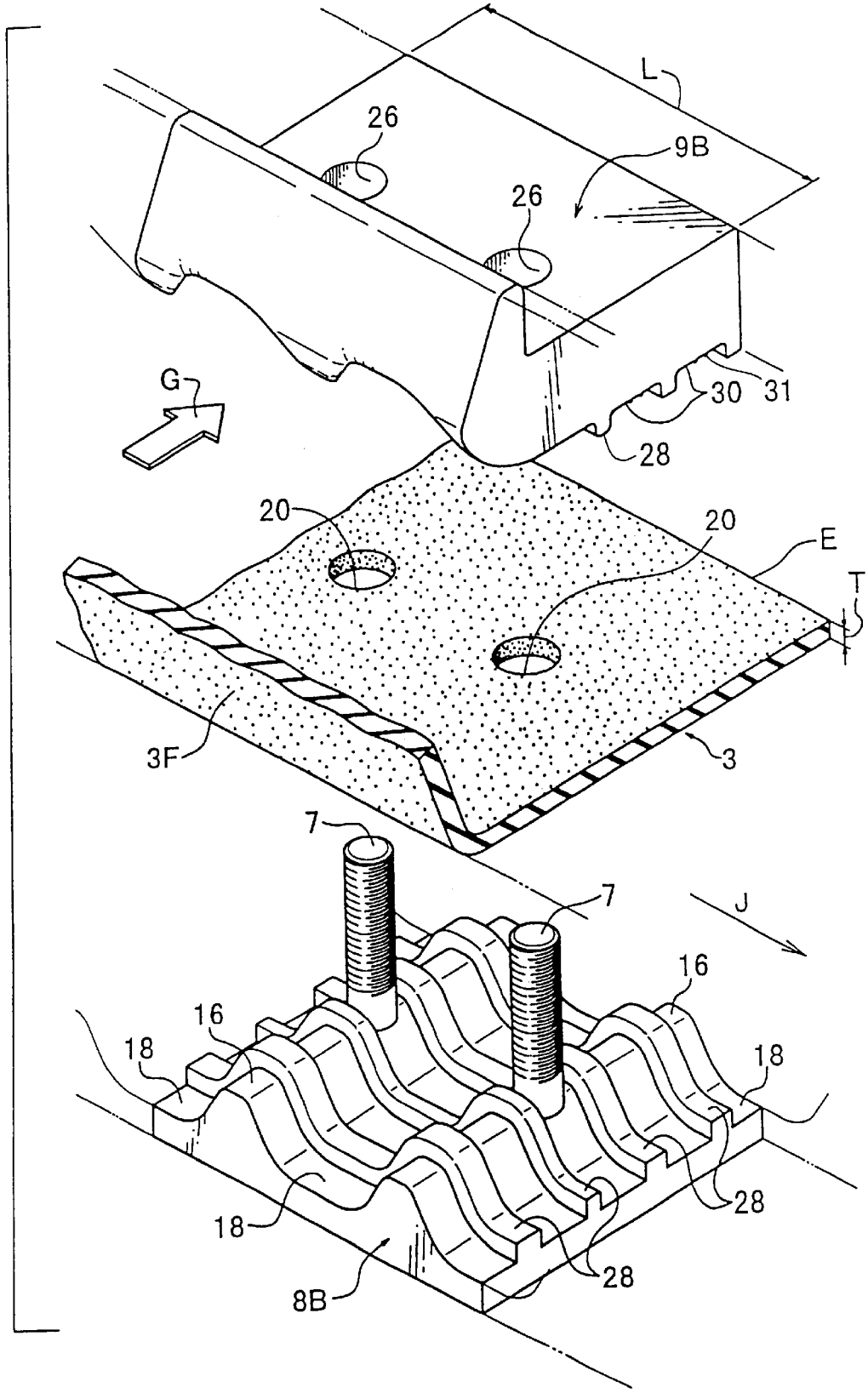
FIG. 5 is an exploded perspective view illustrating the fixing portion of the flexible membrane at the inclined surface portion.

As illustrated in FIGS. 1, 4 and 5, lower pressing hardware 8B (the first member of the present invention), which have a constant width, are placed at portions of the inclined surface portion 5 at which the longitudinal direction end portion 3F of the flexible membrane 3 is to be mounted.

Figure 10A:
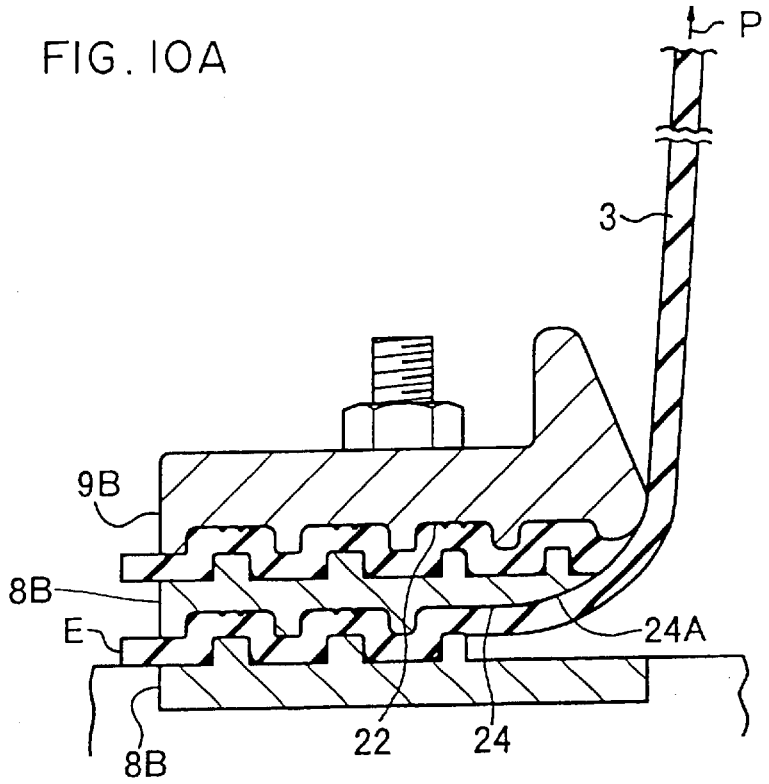
FIG. 10A is a stepped cross-sectional view along both a concave and a convex portion of an upper pressing hardware illustrating a state in which the flexible membrane of the flexible membrane dam relating to the present embodiment is standing.

As can be seen in FIGS. 4 and 5, convex portions 16 and concave portions 18, which extend in a direction substantially orthogonal to the outer peripheral edge E, are formed alternately on the top surface of the lower pressing hardware 8B along the outer peripheral edge E of the flexible membrane 3 (i.e., along the direction of arrow J in FIG. 5). A plurality of ribs 28, which extend along the peripheral edge E of the flexible membrane 3, are formed on the convex portions 16 and the concave portions 18 in order to increase the frictional force with the flexible membrane 3. As shown in FIG. 10A, the rib 28 are not formed on the concave portion 18 which is at the opposite side of the outer peripheral edge E.

The screw portions of the anchor bolts 7 project from vicinities of the centers of the convex portions 16 of the lower pressing hardware 8B.

Bolt holes 20 through which the anchor bolts 7 pass are formed along the outer peripheral edge E in the flexible member 3.

Figure 6:
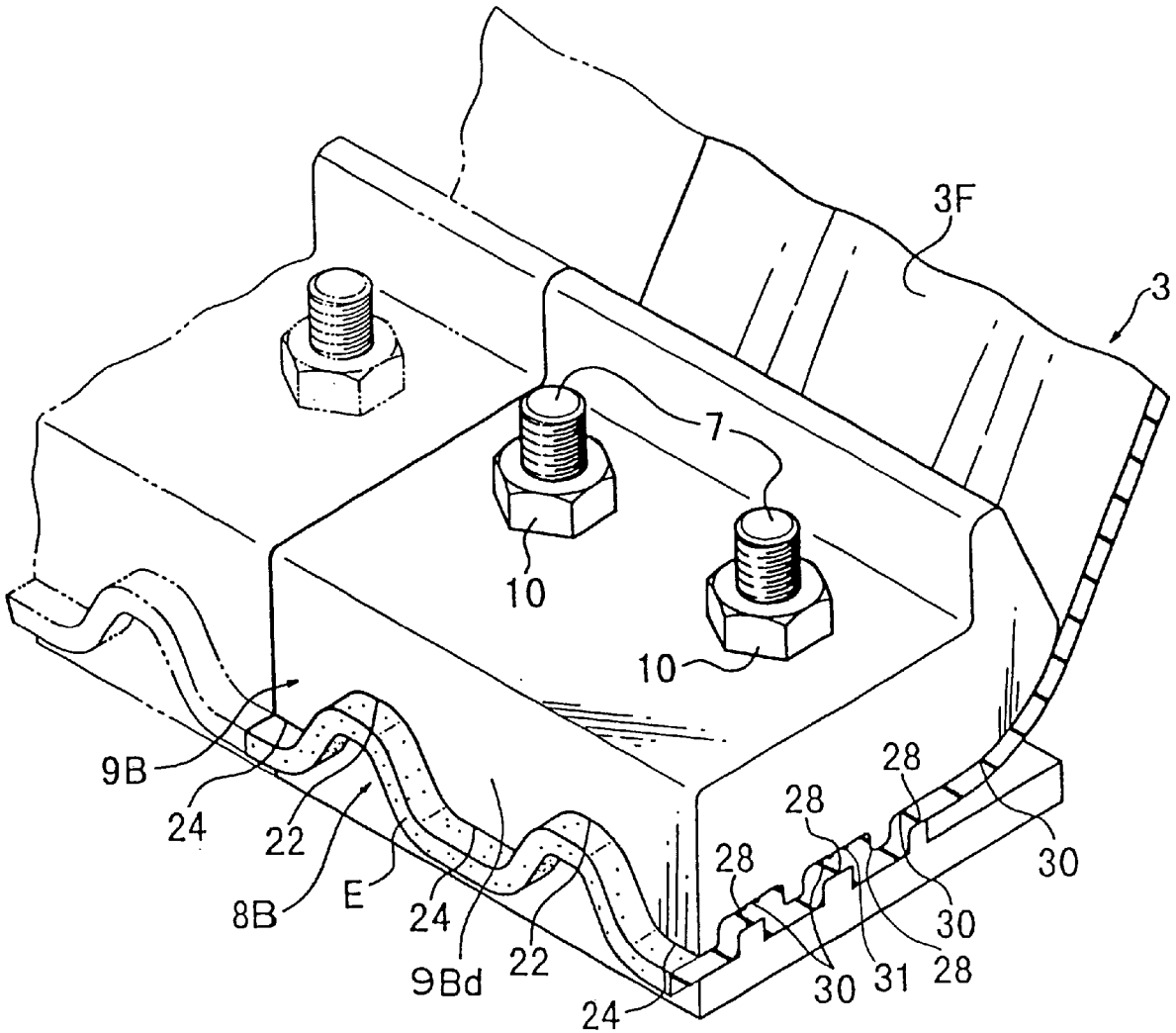
FIG. 6 is a perspective view illustrating the fixing portion of the flexible membrane at the inclined surface portion.

As illustrated in FIGS. 4 and 6, the substantially constant width portion in the vicinity of the outer peripheral edge E (in the vicinity of B1-A1, A1-A3, B4-A3 in FIG. 2) of the longitudinal direction end portion 3F of the flexible membrane 3 is nipped between the lower pressing hardware 8B and upper pressing hardware 9B (the second member of the present invention). The upper pressing hardware 9B has concave portions 22 and convex portions 24 which correspond to the convex portions 16 and the concave portions 18 formed at the lower pressing hardware 8B.

As illustrated in FIGS. 5 and 6, bolt holes 26 through which the anchor bolts 7 pass are formed in the upper pressing hardware 9B. In order to increase the frictional force with the flexible membrane 3, grooves 30 are formed in the bottom surface of the upper pressing hardware 9B at positions opposing the ribs 28 of the lower pressing hardware 8B. Two small ribs 31 are formed in the bottom surface of each groove 30 along the longitudinal direction of the groove 30.

Figure 7:
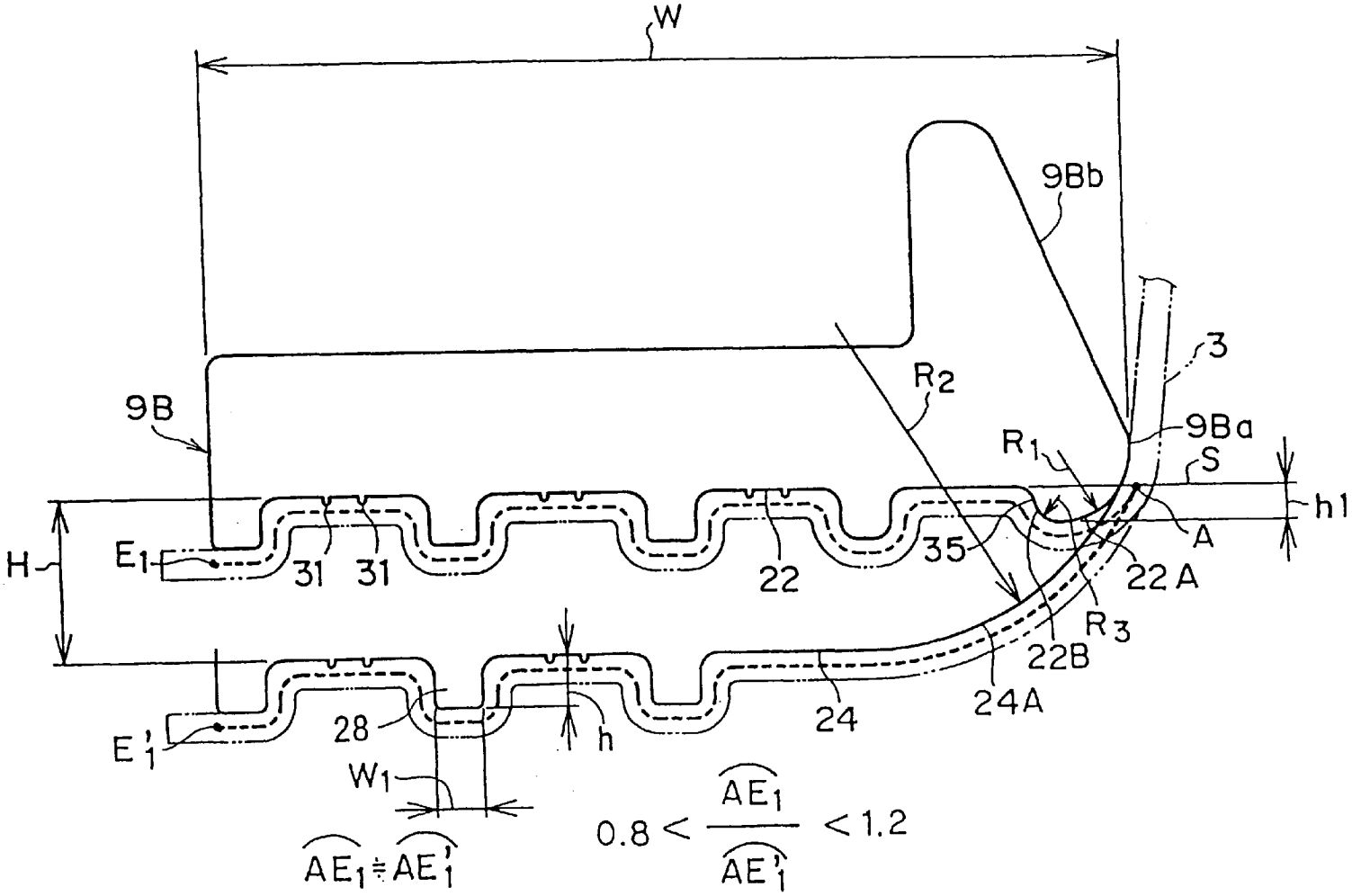
FIG. 7 is an explanatory diagram illustrating lengths of the flexible membrane along concave portions and convex portions of an upper pressing hardware.
Figure 8:
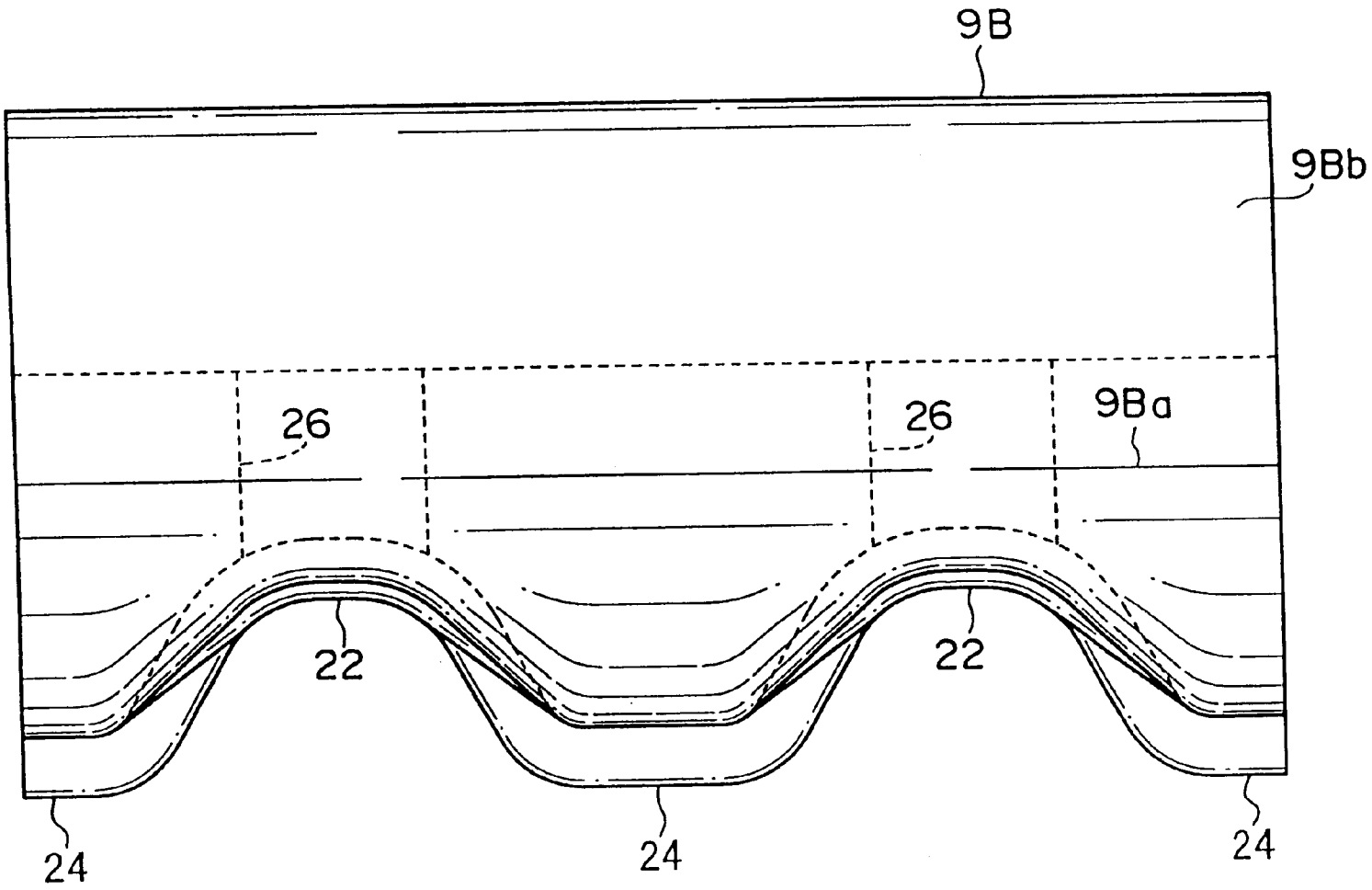
FIG. 8 is a front view (from the direction of arrow G in FIG. 5) of the upper pressing hardware.

As illustrated in FIG. 7, AE1 is the length to a point A from a point E1 (to be described in detail later) which is in a vicinity of the outer peripheral edge of the flexible membrane 3, the length AE1 being measured along the bottom surface of the concave portion 22 when the upper pressing hardware 9B is viewed in cross-section orthogonal to the outer peripheral edge of the flexible membrane 3. (AE1 is the length L1 of the present invention.) AE1' is the length to the point A from a point E1' (to be described in detail later) which is in a vicinity of the outer peripheral edge E of the flexible membrane 3, the length AE1' being measured along the peak surface of the convex portion 24. (AE1' is the length L2 of the present invention.) The value (AE1/AE1')× 100 falls in the range of 80 to 120, and is preferably from 85 to 115, and more preferably from 95 to 105.

In fact, "point A" of the AE1 is different from "point A" of the AE1'. Each "point A" of the AE1 and "the point A" of the AE1' is positioned on the same imaginary line which is perpendicular to the paper of FIG. 7, passing through "A" designated in FIG. 7, but respective "point A" of the AE1 and "point A" of the AE1' are positioned so as to be space apart from each other on the imaginary line. However, because each "point A" of the AE1 and "point A" of the AE1' is positioned at the same point in FIG. 7, for convenience of explanation, "point A" of the AE1 and "point" A of the AE1' are described as the same.

In FIG. 7, the dashed lines are the central line of the flexible membrane 3 in the direction of thickness thereof. E1 and E1' are each the points of intersection of each of the central lines of the flexible membrane 3 in the direction of thickness thereof (the dashed lines in FIG. 7) and an imaginary extended plane extending from an end surface (9Bd in FIG. 6) of the upper pressing hardware 9B in a vicinity of the outer peripheral edge of the flexible membrane 3. A is a point of intersection of said central line, and an imaginary plane S (designated line S in FIG. 7), which is extended from a bottom surface of the groove 30 at the bottom surface of concave portion 22.

In the present embodiment, a rib 35, which has a substantially semicircular cross-sectional configuration, is formed in a vicinity of the end portion at the side (the right side in FIG. 7) of the concave portions 22 of the upper pressing hardware 9B, which side is opposite the outer peripheral edge E side of the flexible membrane 3. The portion of the rib 35 at the side thereof opposite the outer peripheral edge E side (the right side in FIG. 7) is processed by R chamfering (chamfering into a round shape having a radius of curvature) into a circular-arc shape having a small radius of curvature R1 (22A in FIG. 7). The portion of the rib 35 at the outer peripheral edge E side thereof (the left side in FIG. 7) is processed by R chamfering into a circular-arc shape having a radius of curvature R3 (22B in FIG. 7) which is smaller than that of R1.

A vicinity of the end portion of the convex portion 24 of the upper pressing hardware 9B, which end portion is at the side opposite the outer peripheral edge E side (the right side in FIG. 7), is processed by R chamfering into a circular-arc shape having a radius of curvature R2 (24A in FIG. 7) which is larger than R1. Further, there is one fewer rib 33 between the grooves 30 positioned at the convex portions 24 than there are ribs 33 between the grooves 30 positioned at the concave portions 22. In this way, the value (AE1/AE1')×100 falls in the range of 80% to 120%.

Given that the thickness of the flexible membrane 3 is T (see FIG. 5), the relationship between T and the R chamfering processed radius of curvature R2 of the convex portion 24 is R2>2.5T, preferably R>3.0T, and more preferably R>3.5T.

Figure 9:
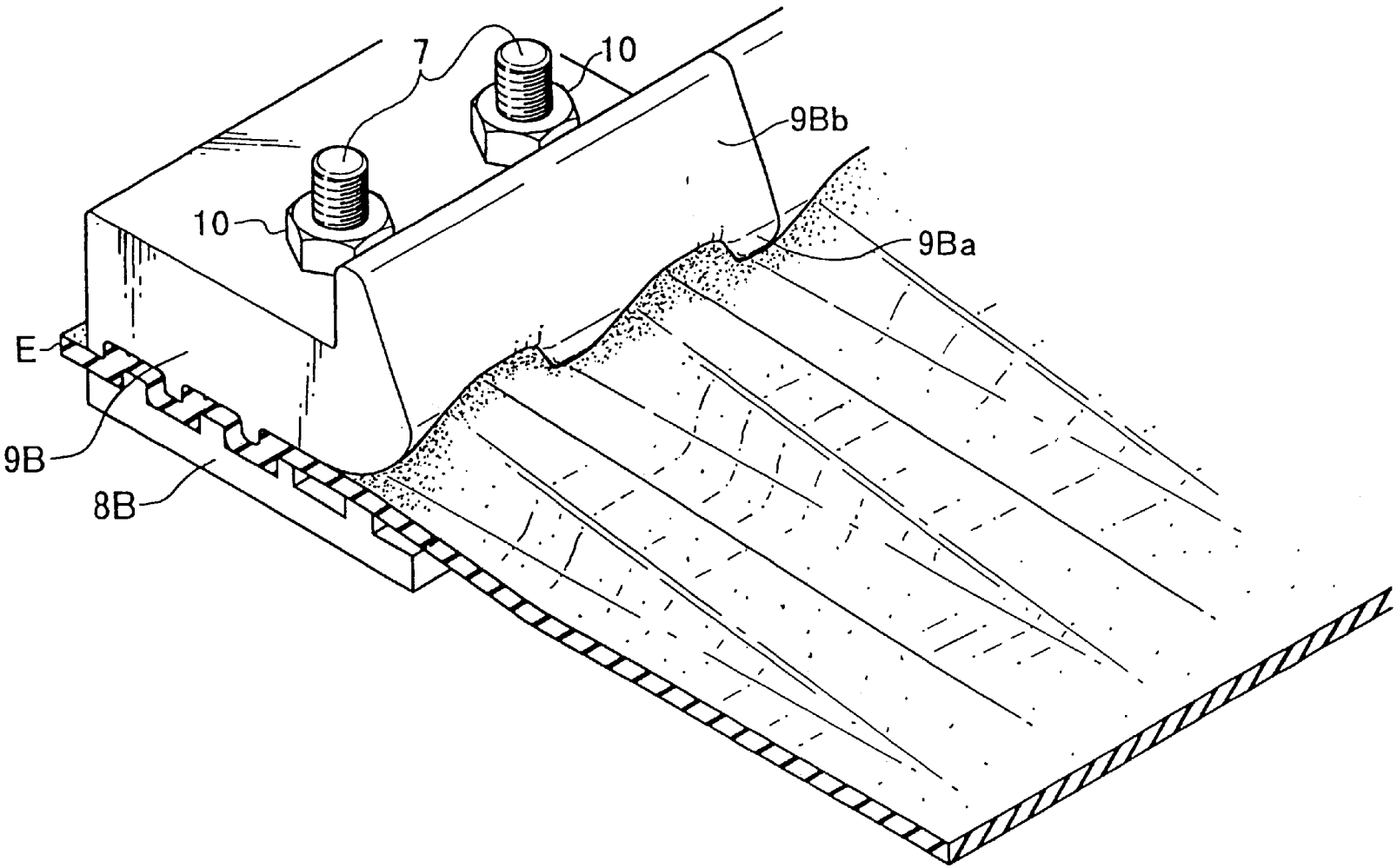
FIG. 9 is a perspective view in a vicinity of the upper pressing hardware and a lower pressing hardware of the flexible membrane when the flexible membrane is collapsed.

As illustrated in FIGS. 5, 7 and 9, an end portion 9Ba of the upper pressing hardware 9B at the side opposite the outer peripheral edge E side is formed substantially linearly along the outer peripheral edge E.

As illustrated in FIGS. 4, 6 and 9, the substantially constant width portions in the vicinities of the outer peripheral edges E at the both end portions of the longitudinal direction end portion 3F are nipped and fixed between the upper pressing hardware 9B and the lower pressing hardware 8B by the nuts 10 being screwed together with and fastening the anchor bolts 7 which pass through the bolt holes 20 of the flexible membrane 3 and the bolt holes 26 of the upper pressing hardware 9B.

A vicinity of an end portion 3D of the longitudinal direction end portion 3F is also nipped between the upper pressing hardware 9B and the lower pressing hardware 8B and is fixed to the inclined surface portion 5.

The method of installation and the effects of the flexible membrane dam 12 relating to the present embodiment will be described hereinafter.

When the side portions 3C of the flexible membrane 3 are mounted to the installation surface 2 by the upper pressing hardware 9A, 9B, in order to form a three-dimensional bag-like body at the time the flexible membrane 3 is inflated and made to stand, by making each the side portions 3C approach the central line CL, the width L at the time of the flexible membrane 3 being laid-out flat can form the peripheral length L of the flexible membrane 3 at the time of the flexible membrane 3 inflating.

In other words, a side portion DI of the flexible membrane 3 moves toward an installation fixing point D2, C1 moves toward C2, and B1 moves toward B2, i.e., D1, C1 and B1 all move in a widthwise direction toward the central line CL. Similarly, at the other side of the flexible membrane 3, a side portion D4 moves toward D3, C4 moves toward C3, and B4 moves toward B3. In addition, A1 moves toward A2, and A3 moves toward A4.

As illustrated in FIG. 2A, because the side B1-A1 of the flexible membrane 3 is mounted to the side B2-A2 of the installation surface 2 whose length is shorter than that of B1-A1, there is some excess flexible membrane 3 at the side B1-A1. Because the side B4-A3 of the flexible membrane 3 is mounted to the side B3-A4 of the installation surface 2 whose length is shorter than that of B4-A3, there is some excess flexible membrane 3 at the side B4-A3. Further, because the side A1-A3 of the flexible membrane 3 is mounted to the side A2-A4 of the installation surface 2 whose length is shorter than that of A1-A3, there is some excess flexible membrane 3 at the side A1-A3. The excess of the flexible membrane 3 is absorbed (applied) by the portions of the flexible membrane 3 between the bolt holes 20 being made to follow along the convex and concave surfaces of the convex portions 16 and concave portions 18 of the lower pressing hardware 8B.

Thereafter, the anchor bolts 7 are inserted into the upper pressing hardware 9B and are screwed together with and fastened by the nuts 10. In this way, as illustrated in FIGS. 4, 6 and 9, the vicinity of the outer peripheral edge E of the flexible membrane 3 is nipped and fixed between the upper pressing hardware 9B and the lower pressing hardware 8B.

In the state in which the flexible membrane 3 is collapsed, as shown in FIG. 9, the portion of the flexible membrane 3 in a vicinity of the upper pressing hardware 9B and the lower pressing hardware 8B is curved convexly and concavely (in a wave-like shape) by the convex portions 16 (not shown), the concave portions 18 (not shown), the concave portions 22, and the convex portions 24. However, the further away from the upper pressing hardware 8B and the lower pressing hardware 9B, the more this wave-like curving of the flexible membrane 3 disappears.

Next, when a fluid such as air is supplied to the interior of the flexible membrane 3, the flexible membrane 3 inflates and stands as illustrated by the two-dot chain line in FIG. 1. When the flexible membrane 3 inflates and stands, tensile force is applied to the flexible membrane 3.

Here, at the inclined surface portions 5, as shown in FIG. 1, the portion of the flexible membrane 3 in a vicinity of the outer peripheral edge E thereof is nipped and fixed between the upper pressing hardware 9B and the lower pressing hardware 8B in a convex and concave shape, as shown in FIG. 6. As shown in FIG. 7, the ratio (AE1/AE1') of the length AE1, from the point E1 of the concave portion 22 to the point A, to the length AE1', from the point E1' of the convex portion 24 to the point A, falls in the range of 80 to 120%. Because the length AE1' is set to be close to the length AE1, as shown in FIG. 10A, drawing up, by the upper pressing hardware 9B when the flexible membrane 3 is inflated can be suppressed. Namely, a concentration of stress at the flexible membrane 3 when the flexible membrane 3 is inflated is suppressed, and the flexible membrane 3 rises planarly from the end portion 9Ba of the upper pressing hardware 9B.

Figure 10B:
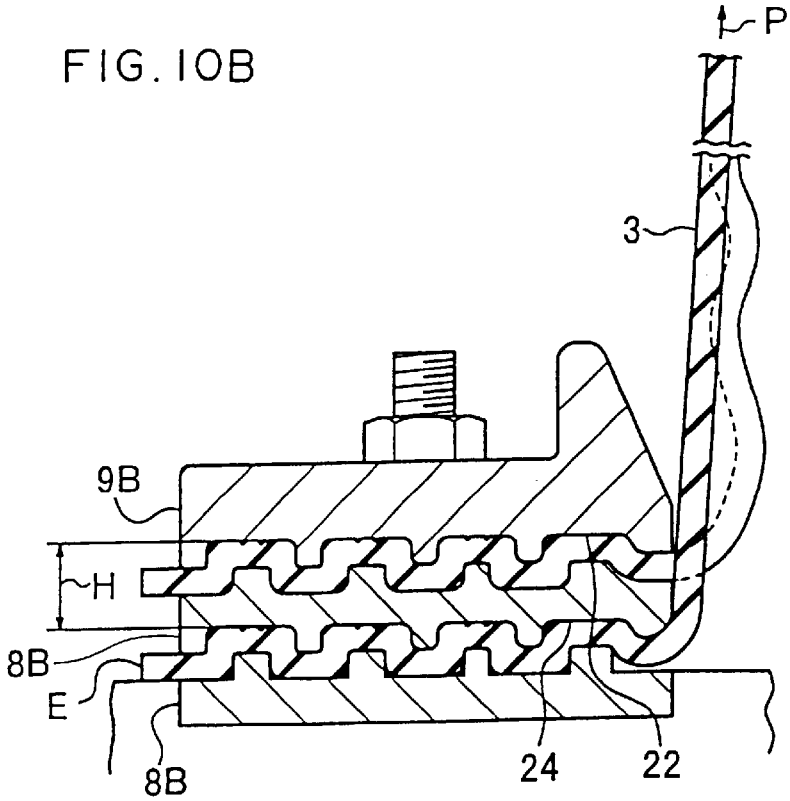
FIG. 10B is a stepped cross-sectional view along both a concave and a convex portion of an upper pressing hardware illustrating a flexible membrane dame, which uses an upper pressing hardware which has not been subjected to R chamfering processing and at which the end portion of a convex portion has a large radius of curvature, in a state in which the flexible membrane dam is standing.

Here, as illustrated in FIG. 10B, if the convex portions 24 were to be parallel to (have substantially the same configurations as) the concave portions 22 in direction W in FIG. 7 (i.e., if the R chamfering processing of the end portion of the convex portion 24 to a radius of curvature of R2 was not carried out), when the flexible membrane 3 was made to stand, the flexible membrane 3 would go slack in a vicinity of the end portion 9Ba by an amount corresponding to the difference H in the heightwise direction between the concave portion 22 and the convex portion 24.

Further, when the internal pressure increases and the flexible membrane 3 is pulled in the direction of arrow P, the slack in flexible membrane 3 in the vicinities of the concave portions 22 would not be eliminated, and instead, a large tensile force would be applied to and a large stress would be generated at the portions of the flexible membrane 3 in vicinities of the convex portions 24. Namely, there would be a concentration of stress at the flexible membrane 3.

If (AE1/AE1')×100 falls out of the range of 80 to 120, when the flexible membrane 3 is inflated, there is local concentration of stress at the. flexible membrane 3 in a vicinity of the upper pressing hardware 9B, which is not preferable.

Moreover, if the radius of curvature R2≦2.5T, the end portions of the upper pressing hardware 9B would be more sharp, which would not be preferable.

In the present embodiment, in order for the length AE1' to be close to the length AE1, the convex portions 24 of the upper pressing hardware 9B are subjected to R chamfering processing (24A in FIG. 7), and the convex portions 24 have one rib 28 less than the concave portions. However, instead of the to R chamfering processing, the convex portions 24 may be chamfered to a polygonal shape or to be inclined surfaces (so-called C chamfering), and the number of ribs 28 may be adjusted appropriately.

Further, in the flexible membrane dam 12 of the present embodiment, it suffices to mount the lower pressing hardware 8B to the planar inclined surface portion 5. Execution of works of the flexible membrane dam 12 is easy because there is no need to form complex configurations such as step-shaped configurations or the like in the inclined surface portion 5.

Further, the present invention encompasses any and all configurations of the upper pressing hardware which result in the length AE' and the length AE being equal, i.e., which absorb the difference H in the hightwise direction between the top surface of the convex portion 24 and the bottom surface of the concave portion 22 of the upper pressing hardware.

Figure 11:
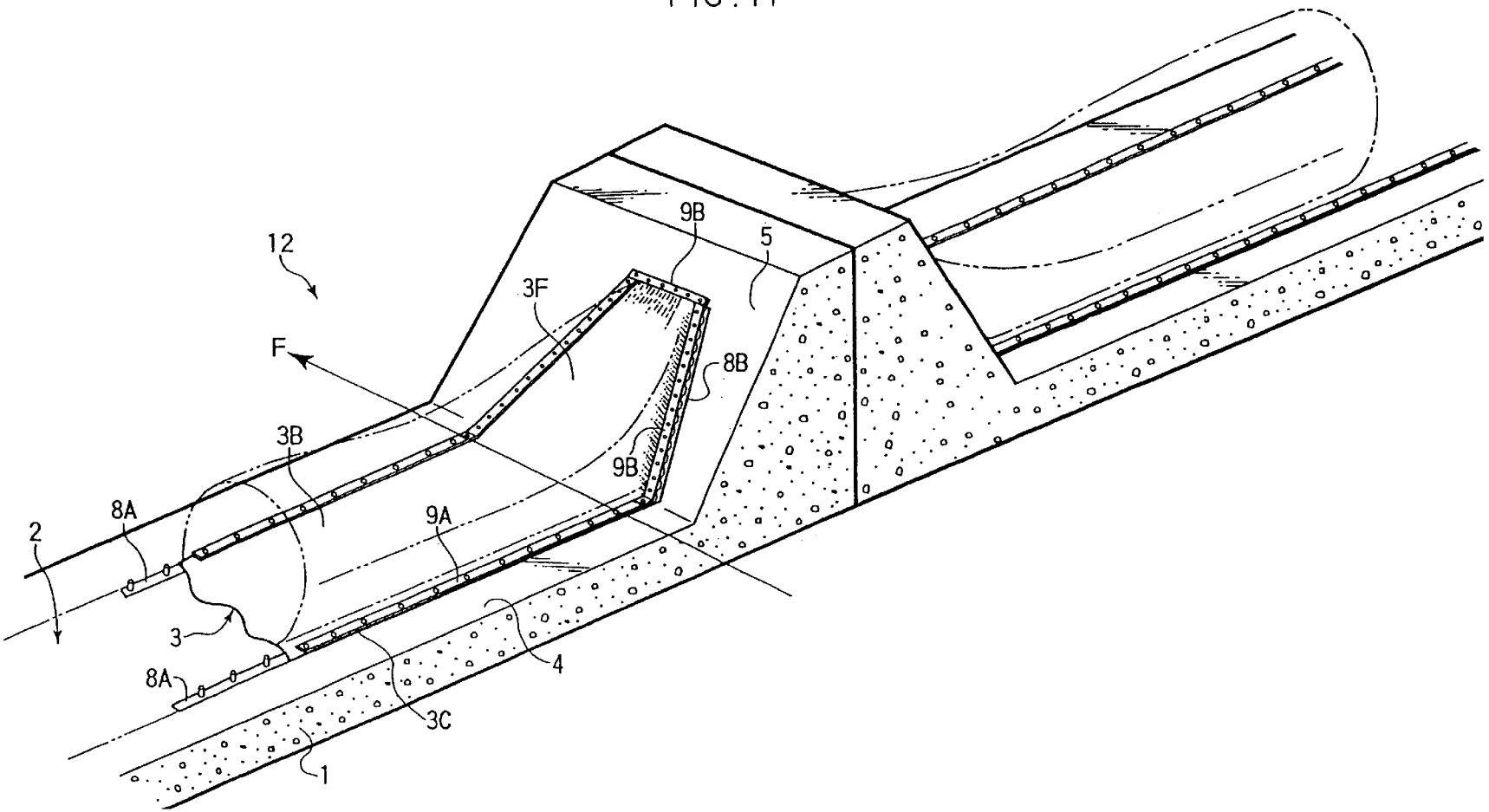
FIG. 11 is a perspective view illustrating a flexible membrane dam relating to another embodiment of the present invention.

In the above-described embodiment, one mounting base 1 shown in FIG. 1 can be provided, for example, in a river along the widthwise direction thereof. Also, as is shown in FIG. 11, plural mounting bases can be provided (e.g., with their longitudinal direction ends connected to one another), for example, in a river along the widthwise direction thereof.

Because the mounting member of the present invention is as described above, when the flexible membrane is set in a river, installation at the inclined surfaces portion is easy. Further, stress does not concentrate at the flexible membrane when the flexible membrane is inflated to stand.

Because the flexible membrane dam is structured as described above, when the flexible membrane is set in a river, installation at the inclined surfaces portion is easy. Further, stress does not concentrate at the flexible membrane when the flexible membrane is inflated to stand.

What is claimed is:

1. A mounting member used in a flexible membrane dam which is formed by a flexible expanding-and-contracting structural body which is formed from a flexible membrane and is made to stand by a fluid being supplied to an interior thereof and made to collapse by fluid being discharged from the interior thereof; and a structure at which the flexible expanding-and-contracting structural body is provided, said mounting member comprising:

a first member and a second member, wherein said first member is designed to be provided at the structure for abutting one surface of the flexible membrane, said second member is designed to be opposite the first member for abutting another surface of the flexible membrane, such that a vicinity of an outer peripheral edge of the flexible membrane is nipped by a fixing means between said first member and said second member, at a surface of the first member for abutting the flexible membrane, first concave portions and first convex portions, which extend in a direction that is orthogonal to the outer peripheral edge of the flexible membrane when the mounting member mounts the flexible membrane, are provided alternately along the outer peripheral edge of the flexible membrane when the mounting member mounts the flexible membrane, at a surface of the second member for abutting the flexible membrane, second convex portions which oppose the first concave portions and second concave portions which oppose the first convex portions are provided alternately along the outer peripheral edge of the flexible membrane when the mounting member mounts the flexible membrane, whereby when the mounting member mounts the flexible membrane a length L1 of the flexible membrane, in a state in which the flexible membrane is set in close contact with bottom surface of the second concave portion, from a flexible membrane outer peripheral edge side end portion of the second concave portion to an end portion of the second concave portion at a side opposite the flexible membrane outer peripheral edge side of the second concave portion, and a length L2 of the flexible membrane, in a state in which the flexible membrane is set in close contact with peak surface of the second convex portion, from a flexible membrane outer peripheral edge side end portion of the second convex portion to an end portion of the second convex portion at a side opposite the flexible membrane outer peripheral edge side of the second convex portion, are substantially equal.

2. A mounting member according to claim 1, wherein (L1/L2)×100 is substantially in a range of 80 to 120 when the mounting member mounts the flexible membrane.

3. A mounting member according to claim 1, wherein a plurality of ribs extending along the outer peripheral edge of the flexible membrane are provided at the surface of the second member which abuts the flexible membrane, and a number of ribs provided at the second convex portion is smaller than a number of ribs provided at the second concave portion.

4. A mounting member according to claim 1, wherein an end portion of said second member at a side opposite a flexible membrane outer peripheral edge side of said second member includes a chamfer.

5. A mounting member according to claim 4, wherein the chamfer has a radius of curvature.

6. A mounting member according to claim 5, wherein the flexible membrane has a thickness T, and a radius of curvature at the second convex portion is R, R>2.5T.

7. A mounting-member according to claim 5, wherein a radius of curvature at the second concave portion is smaller than the radius of curvature at the second convex portion.

8. A flexible membrane dam formed by a flexible expanding-and-contracting structural body which is formed from a flexible membrane and is made to stand by a fluid being supplied to an interior thereof and made to collapse by fluid being discharged from the interior thereof; and a structure at which the flexible expanding-and-contracting structural body is provided, said flexible membrane dam having a mounting member, said mounting member being formed by a first member and a second member, wherein said first member is provided at the structure and abuts one surface of the flexible membrane, said second member abuts another surface of the flexible membrane, a vicinity of an outer peripheral edge of the flexible membrane is nipped by a fixing means between said first member and said second member, at a surface of the first member which abuts the flexible membrane, first concave portions and first convex portions, which extend in a direction orthogonal to the outer peripheral edge of the flexible membrane, are provided alternately along the outer peripheral edge of the flexible membrane, at a surface of the second member which abuts the flexible membrane, second convex portions which oppose the first concave portions and second concave portions which oppose the first convex portions are provided alternately along the outer peripheral edge of the flexible membrane, and a length L1 of the flexible membrane, in a state in which the flexible membrane is set in close contact with bottom surface of the second concave portion, from a flexible membrane outer peripheral edge side end portion of the second concave portion to an end portion of the second concave portion at a side opposite the flexible membrane outer peripheral edge side of the second concave portion, and a length L2 of the flexible membrane, in a state in which the flexible membrane is set in close contact with peak surface of the second convex portion, from a flexible membrane outer peripheral edge side end portion of the second convex portion to an end portion of the second convex portion at a side opposite the flexible membrane outer peripheral edge side of the second convex portion, are substantially equal.

9. A flexible membrane dam according to claim 8, wherein (L1/L2)×100 is substantially in a range of 80 to 120.

10. A flexible membrane dam according to claim 8, wherein a plurality of ribs extending along the outer peripheral edge of the flexible membrane are provided at the surface of the second member which abuts the flexible membrane, and a number of ribs provided at the second convex portion is smaller than a number of ribs provided at the second concave portion.

11. A flexible membrane dam according to claim 8, wherein an end portion of said second member at a side opposite a flexible membrane outer peripheral edge side of said second member includes a chamfer.

12. A flexible membrane dam according to claim 11, wherein the chamfer has a radius of curvature.

13. A flexible membrane dam according to claim 12, wherein the flexible membrane has a thickness T, and a radius of curvature at the second convex portion is R, R>2.5T.

14. A flexible membrane dam according to claim 12, wherein a radius of curvature at the second concave portion is smaller than the radius of curvature at the second convex portion.

15. A device for fastening a flexible membrane of an inflatable dam to a supporting structure, the device comprising:

(a) a first member having a serpentine surface that varies in serpentine fashion along a longitudinal direction of the first member, and an opposing surface for placement against a supporting structure;

(b) a second member having a serpentine surface corresponding to the serpentine surface of the first member, wherein when the device fastens a flexible membrane of a dam to a supporting structure, a section of the flexible member is sandwiched between the serpentine surfaces of the first and second members, with at least a portion of said serpentine surfaces nesting with one another; and (c) bolts connecting the first and second members against a supporting structure, when the device fastens a flexible membrane of an inflatable dam to a supporting structure, wherein the serpentine surface of the second member varies in serpentine fashion along the longitudinal direction, said serpentine surface of the second member having a contour and a length measured transverse to said longitudinal direction along said contour, wherein when the device fastens a flexible membrane of a dame to a supporting structure with a section of the flexible member sandwiched between the serpentine surfaces, the section has a length, and the ratio of said length of said section to said length of said second member has an approximate range from 0.80 to 1.20.

16. A device for fastening a flexible membrane of an inflatable dam to a supporting structure, the device comprising:

(a) a first member having a serpentine surface that varies in serpentine fashion along a longitudinal direction of the first member, and an opposing surface for placement against a supporting structure;

(b) a second member having a serpentine surface corresponding to the serpentine surface of the first member, wherein when the device fastens a flexible membrane of a dam to a supporting structure, a section of the flexible member is sandwiched between the serpentine surfaces of the first and second members, with at least a portion of said serpentine surfaces nesting with one another; and (c) bolts connecting the first and second members against a supporting structure, when the device fastens a flexible membrane of an inflatable dam to a supporting structure, wherein the serpentine surfaces of the first and second members each include ribs, with the ribs of each serpentine surface being offset from the ribs of the other serpentine surface, when the device fastens a flexible membrane of a dam to a supporting structure with a section of the flexible membrane sandwiched between the serpentine surfaces, and at least a portion of said serpentine surfaces nesting with one another.

17. The device of claim 16, wherein one member has a serpentine surface with less ribs than the serpentine, surface of the other member.

18. The device of claim 16, wherein the first member has a serpentine surface with less ribs than the serpentine surface of the other member.

19. A mounting member used in a flexible membrane dam which is formed by a flexible expanding-and-contracting structural body which is formed from a flexible membrane and is made to stand by a fluid being supplied to an interior thereof and made to collapse by fluid being discharged from the interior thereof; and a structure at which the flexible expanding-and-contracting structural body is provided, said mounting member comprising:

a first member and a second member, wherein said first member is designed to be provided at the structure for abutting one surface of the flexible membrane, said second member is designed to be opposite the first member for abutting another surface of the flexible membrane, such that a vicinity of an outer peripheral edge of the flexible membrane is nipped by a fixing means between said first member and said second member, at a surface of the first member for abutting the flexible membrane, first concave portions and first convex portions, which extend in a direction that is orthogonal to the outer peripheral edge of the flexible membrane when the mounting member mounts the flexible membrane, are provided alternately along the outer peripheral edge of the flexable membrane when the mounting member mounts the flexible membrane, at a surface of the second member for abutting the flexible membrane, second convex portions which oppose the first concave portions and second concave portions which oppose the first convex portions are provided alternately along the outer peripheral edge of the flexible membrane when the mounting member mounts the flexible membrane, a plurality of ribs provided at the second convex portions, and a plurality of ribs provided at the second concave portions, whereby when the mounting member mounts the flexible membrane a length L1 of the flexible membrane, in a state in which the flexible membrane is set in close contact with bottom surface of the second concave portion, from a flexible membrane outer peripheral edge side end portion of the second concave portion to an end portion of the second concave portion at a side opposite the flexible membrane outer peripheral edge side of the second concave portion, and a length L2 of the flexible membrane, in a state in which the flexible membrane is set in close contact with peak surface of the second convex portion, from a flexible membrane outer peripheral edge side end portion of the second convex portion to an end portion of the second convex portion at a side opposite the flexible membrane outer peripheral edge side of the second convex portion, are substantially equal.

20. A mounting member according to claim 19, where in a plurality of ribs extending along the outer peripheral edge of the flexible membrane are provided at the surface of the member.

* * * * *